United States Patent [19]

Maekawa et al.

[11] Patent Number: 4,823,512

[45] Date of Patent: Apr. 25, 1989

[54] WIRE-TYPE WINDOW REGULATOR WITH WIRE TENSIONER

[75] Inventors: Junichi Maekawa, Yokohama; Satoru Ugawa, Hadano, both of Japan; Satoshi Obuchi, deceased, late of Fukuoka, Japan, by Fukashi Obuchi, Ruriko Obuchi, Legal Representatives

[73] Assignees: Nissan Motor Co., Ltd.; Ohi Siesakusho Co., Ltd., both of Yokohama, Japan

[21] Appl. No.: 915,653

[22] Filed: Oct. 6, 1986

[30] Foreign Application Priority Data

Oct. 7, 1985 [JP] Japan ..... 60-221839

[51] Int. Cl.[4] ..... E05F 11/48

[52] U.S. Cl. ..... 49/352

[58] Field of Search ..... 49/352

[56] References Cited

U.S. PATENT DOCUMENTS

| | | | |
|---|---|---|---|
| 3,209,412 | 10/1965 | Golde | 49/352 X |
| 4,235,046 | 11/1980 | Hess et al. | 49/352 |
| 4,237,657 | 12/1980 | Kazewych | 49/352 |
| 4,442,632 | 4/1984 | Greco et al. | 49/352 |
| 4,502,247 | 3/1985 | Kobayashi et al. | 49/352 |
| 4,630,398 | 12/1986 | Schust | 49/352 |
| 4,637,166 | 1/1987 | Ujihara | 49/352 |

FOREIGN PATENT DOCUMENTS 55-30095 3/1980 Japan .

*Primary Examiner*—Philip C. Kannan

*Attorney, Agent, or Firm*—Foley & Lardner, Schwartz, Jeffery, Schwaab, Mack, Blumenthal & Evans

[57] ABSTRACT

Pull-up and pull-down wires extend toward each other from opposed positions with respect to a glass pane carrying member and are connected at their leading ends to spaced portions of the carrying member in such a manner that the two wires extend along a common line. A wire tensioner is mounted on the carrying member for tensioning the wires. The tensioner includes a torsion spring having outwardly extending end portions at least one of which is engaged with the leading end of one of the wires to bias the same toward the other.

17 Claims, 4 Drawing Sheets

WIRE-TYPE WINDOW REGULATOR WITH WIRE TENSIONER

BACKGROUND OF THE INVENTION

1. Field of the Invention

The present invention relates in general to a door window regulator for an automotive vehicle, and, more particularly, to a wire-type door window regulator having a wire tensioner.

2. Description of the Prior Art

In order to clarify the operation of the present invention, one conventional door window regulator will be outlined with reference to FIG. 5, which is disclosed in Japanese Patent First Provisional Publication No. 55-30095.

The door window regulator comprises a guide rail (a) secured to a door panel (not shown), a carrier member (b) slidably movable along the guide rail (a) and carrying thereon a window glass pane (c), pull-up and pull-down wires (d, e), each having a leading end fixed to the carrier member (b) and a drive unit (f) mounted to the door panel to drive the wires (d, e) upward or downward. Upon operation of the drive unit (f), the carrier member (b) is thus moved upward or downward together with the glass pane (c) along a path designated by reference (g). In order to compensate for an unavoidable permanent elongation of the wires (d, e), wire tensioners are arranged on the carrier member (b). Each tensioner comprises a wire end gripper (h, h') fixed to the leading end of each wire (d, e), a bracket (i, i') secured to the carrier member (b) and a coil spring (j, j') compressed between the wire end gripper and the corresponding bracket. By means of the coil springs (j, j'), the wires (d, e) are kept tensioned.

However, the window regulator as described hereinabove has the following drawbacks.

(1) Since the wire tensioners are arranged at laterally different positions of the carrier member, (b) the associated wires (d, e) extend along different ways, and the action points of the wires (d, e) to the carrier member (b) are compelled to change considerably depending on the direction in which the carrier member (b) moves, that is, depending on whether the carrier member (b) moves upward or downward. The change of the action points causes each wire (d, e) to run along different paths on its upward and downward movements, so that, when, for instance, the carrier member (b) is under its upward movement, the length of the pull-up wire (d) retracted by the drive unit (f) becomes different from that of the pull-down wire (e) released from the drive unit (f). This uneven travelling of the wires (d, e) tends to induce slippage of one wire on the winding drum of the drive unit (f) thereby impairing the operation of the window regulator.

(2) Because of the two bulky coil springs (j, j'), the carrier member (b) is bulky. As is known, the bulky construction is not desirable because of a limited space available in the door construction in which the window regulator is installed.

(3) Because of the coil springs (j, j'), which are forced to change their axial lengthes during operation of the window regulator, the determination of the length of each wire (d, e) must be made by taking the changeable length of each coil spring (j, j') into consideration, and this is very difficult.

(4) During operation of the drive unit (f) to effect upward or downward movement of the carrier member (b), a considerable degree of compression force is suddenly applied to the spring (j) or (j') because of the considerable weight of the glass pane (c) applied to the carrier member (b). This sometimes brings about undesirable jamming of the turns of the coil spring (j) or (j').

SUMMARY OF THE INVENTION

It is therefore an essential object of the present invention to provide an improved door window regulator which is free of the above-mentioned drawbacks.

According to the present invention, there is provided a door window regulator for moving a window glass pane relative to a door in which the regulator is mounted, the window regulator comprising a guide rail attached to the door, a carrier member slidably engaged with the guide rail to run along the same, the carrier member carrying thereon the window glass pane, pull-up and pull-down wires which extend toward each other from opposed positions with respect to the carrier member and connected at their leading ends to spaced portions of the carrier member in such a manner that the wires extend along a common line, drive means for driving the wires and thus the carrier member along the guide rail, and a wire tensioner mounted on the carrier member for tensioning the wires, the wires tensioner including a torsion spring having outwardly extending end portions, one end portion of the torsion spring being engaged with the leading end of one of the wires to bias the same toward the other wire.

DETAILED DESCRIPTION OF THE INVENTION

Throughout the description, the terms "forward", "rearward", "upward" and "rearward" refer to the motor vehicle to which the window regulator of the invention is mounted.

Figure 1:
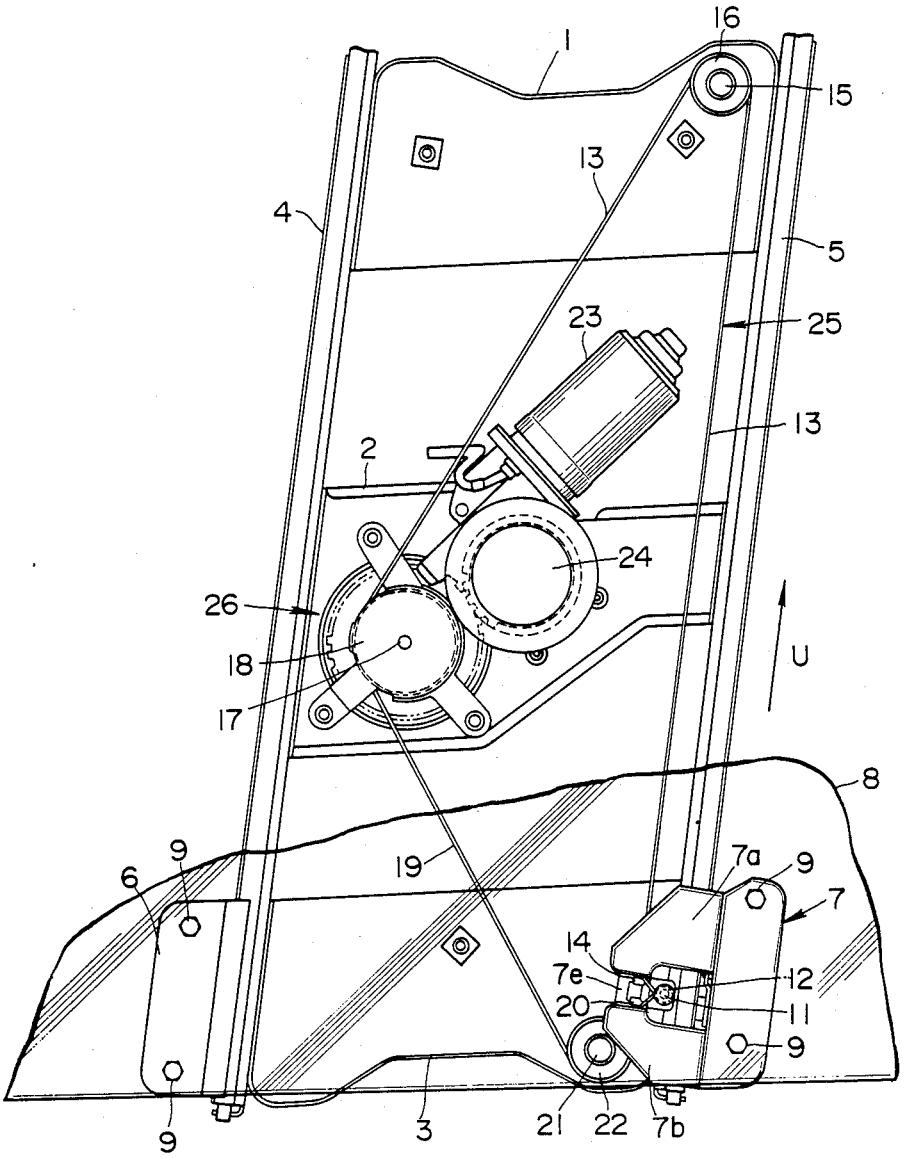
FIG. 1 is a front view of a door window regulator of a first embodiment of the present invention.
Figure 2:
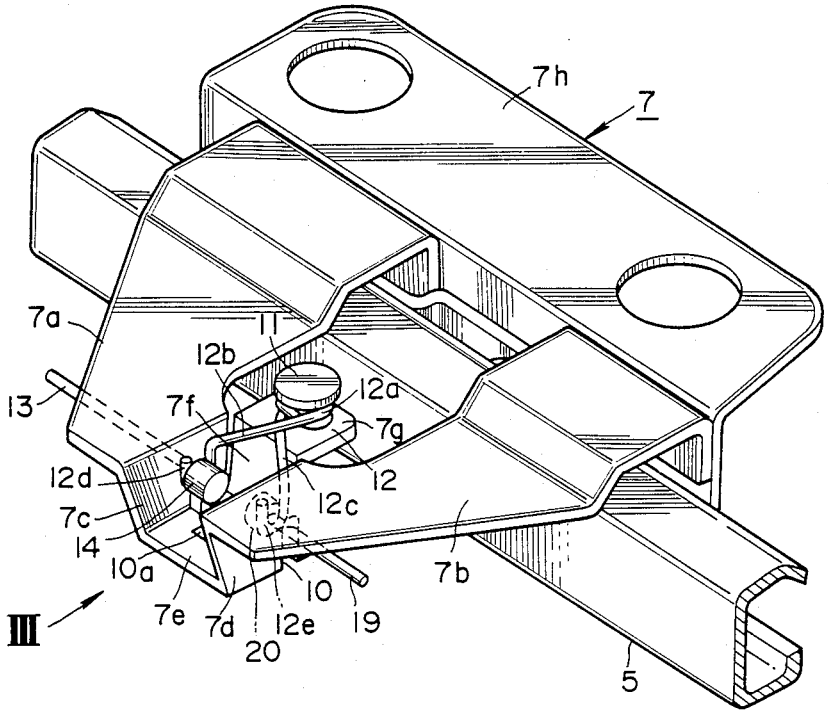
FIG. 2 is an enlarged perspective view of a carrier member employed in the window regulator of the first embodiment.
Figure 3:
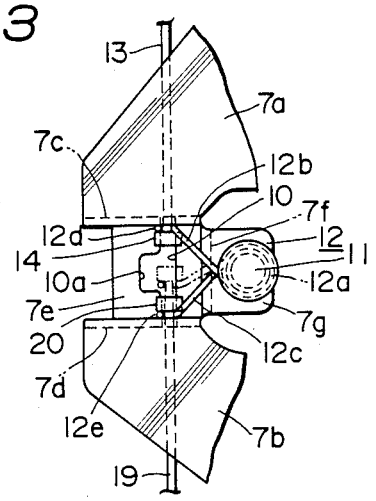
FIG. 3 is a partial view taken from the direction of the arrow "III" of FIG. 2.

Referring to FIGS. 1 to 3, there is shown a door window regulator of a first embodiment of the present invention, which is mounted in a side door hinged to a left side of a motor vehicle.

Supporting plates 1, 2 and 3 are respectively secured to upper, middle and lower portions of an inner panel (not shown) of the door. Two guide rails 4 and 5 are secured to forward and rearward sides of the supporting plates 1, 2 and 3 to extend in parallel relationship in the vertical direction inclining somewhat toward the rear of the vehicle (viz., toward the right in FIG. 1). As will be seen from FIG. 2, each guide rail 4 or 5 has a generally C-shaped cross section and is arranged with its longitudinally extending slit facing forward or rearward of the vehicle.

A guide plate 6 is slidably engaged with the forward guide rail 4, and a carrier member 7 is slidably engaged with the rearward guide rail 5. Although not shown in the drawings, suitable rollers are arranged in the guide plate 6 and the carrier member 7 in order to smooth their movement along the guide rails 4 and 5.

The guide plate 6 and the carrier member 7 are secured to a lower portion of a window glass pane 8 by means of bolts 9. The guide plate 6, the carrier member 7 and the window glass pane 8 thus move as a unit along the guide rails 4 and 5.

As is best understood from FIG. 2, the carrier member 7 comprises a base plate 7h having two openings (no numerals) through which the bolts 9 pass for connection with the glass pane 8. A generally C-shaped wire holding plate extends from the base plate 7h and straddles the rearward guide rail 5. As described hereinafter, the wire holding plate holds leading ends of pull-up and pull-down wires 13 and 19. The wire holding plate includes two spaced lug portions **7*a* and 7*b* secured at their foot portions to the base plate 7*h* and straddling the guide rail 5. The spaced lug portions 7*a* and 7*b* are integrally connected at their leading end portions through a depressed bridge portion. The bridge portion comprises two side walls 7*c* and 7*d* extending perpendicular from the respective lug portions 7*a* and 7*b*, a bottom portion 7*e* integrally connected with the side walls 7*c* and 7*d* and a rear wall 7*f* raised from the rear end of the bottom portion 7*e*. The rear wall 7*f* has a terrace portion 7*g* extending rearward from the top of the rear wall 7*f*. In the illustrated embodiment, the surface of the terrace portion 7*g* is substantially flush with the surfaces of the lug portions 7*a* and 7*b***.

As is understood from FIG. 3, the bridge portion is formed with a slit 10 which extends from a middle portion of the side wall **7*c* to a middle portion of the other side wall 7*d*, thereby crossing the bottom portion 7*e*. The slit 10 of the bottom portion 7*e* is formed with an enlarged rectangular portion 10*a* which protrudes toward the front of the bottom portion 7*e***, as shown.

A headed pin 11 is fixed to the terrace portion **7*g* of the rear wall 7*f* for retaining a torsion spring 12. That is, the spring 12 is disposed at its turned section 12*a* about the pin 11 with its two legs 12*b* and 12*c* crossing each other and extending outwardly, as shown. The leading ends of the legs 12*b* and 12*c* are curled to form U-shaped holder portions 12*d* and 12*e*, respectively. Under the unloaded condition of the spring 12, the two legs 12*b* and 12*c* assume their mutually close neutral positions. Thus, when the legs 12*b* and 12*c* are expanded away from each other, a biasing force for bringing them close to each other is created in the spring 12**.

Figure 5:
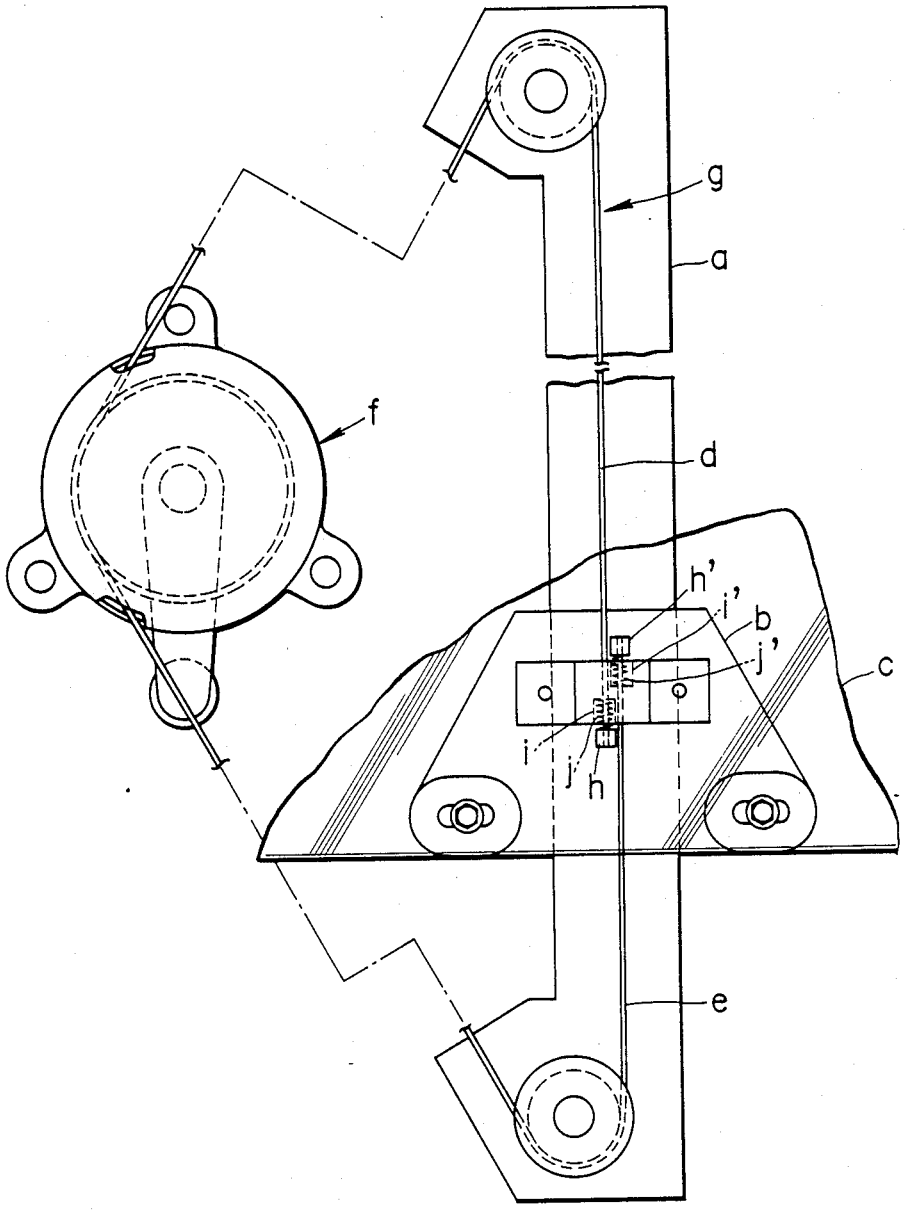
FIG. 5 (PRIOR ART)
FIG. 5 is a front view of a conventional door window regulator.

Similar to the conventional device of FIG. 5, a pull-up wire 13 and a pull-down wire 19 extend from a drive unit 26 to the carrier member 7 to move the same. Wire end grippers 14 and 20 are fixed to the leading ends of the wires 13 and 19, respectively. As is best understood from FIG. 2, the wire end grippers 14 and 20 are put in the depressed bridge portion having their associated wires 13 and 19 passed through the slits 10 formed in the side walls **7*c* and 7*d*. The U-shaped holder portions 12*d* and 12e of the spring legs 12*b* and 12*c* are disposed between the gripper 14 and the side wall 7*c* and between the gripper 20 and the other side wall 7*d*, respectively, and hold the associated wires 13 and 19. For the reasons as has been described hereinabove, the legs 12*b* and 12*c* of the spring 12 thus bias the two grippers 14 and 20 toward each other thereby pulling and tensioning the pull-up and pull-down wires 13 and 19. The tension spring 12, the wire end grippers 14 and 20 and the pin 11 constitute a so-called wire tensioner. Setting the wire end grippers 14 and 20 to the bridge portion of the carrier member is easily achieved with the enlarged rectangular opening 10*a* of the slit 10. Of course, the opening 10*a* is so sized and formed as to receive the grippers 14 and 20**.

As is seen from FIG. 1, the drive unit 26 comprises a winding drum 18 about which the pull-up and pull-down wires 13 and 19 are wound in mutually opposed directions in a known manner. The drum 18 has a rotation shaft 17. This winding drum 18 is driven by a reversable electric motor 23 though a speed reduction gear 24. As shown, the pull-up wire 13 extends upward from the winding drum 18 to engage an upper pulley 16 and then extends downward toward the carrier member 7. The pull-down wire 19 extends downward from the winding drum 18 to engage a lower pulley 22 and then extends upward through the carrier member 7. The pulleys 16 and 22 comprise pivot shaft 15 and 21, respectively.

Thus, it will be appreciated that upon operation of the drive unit 26, the pull-up and pull-down wires 13 and 19 move along a path designated by numeral 25.

Upon energization of the motor 23, the winding drum 18 is turned in a counterclockwise direction in FIG. 1, the pull-up wire 13 is retracted by the drum 18 and the pull-down wire 19 is released from the drum 18 to the same extent as the pull-up wire 13. By this operation, the wires 13 and 19 run in the direction of the arrow U thereby moving the carrier member 7 and thus the window glass pane 8 upward along the guide rails 4 and 5.

Upon reversed operation of the motor 23, the winding drum 18 is turned in clockwise direction in FIG. 1, the pull-down wire 19 is retracted by the drum 18 and the pull-up wire 13 is released from the drum 18 to the same extent as the pull-down wire 19. By this operation, the carrier member 7 and thus the window glass pane 8 are moved downward along the guide rails 4 and 5.

If both the wires 13 and 19 are sufficiently tensioned, the wire end gripper 14 or 20, the U-shaped holder portion **12*d* or 12e of the spring leg 12*b* or 12*c* and the side wall 7*c* or 7*d* of the carrier member 7 are kept in intimate engagement with one another. Thus, in this condition, the movements of the wires 13 and 19 are reliably transmitted to the carrier member 7** without any lag.

When one of the wires 13 and 19, such as for example, the pull-down wire 19, becomes slackened due to permanent set or the like, the biasing force of the spring 12 moves the leg **12*c* toward the other leg 12*b*, that is, to a position illustrated by the broken lines in FIG. 3. The pull-down wire 19 is thus pulled upward and tightened and tensioned. It is to be noted that any slack produced in the pull-up wire 13 would disappear automatically because of a slight lowering of the carrier member due to the considerable weight of the glass pane 8 which is constantly applied to the carrier member 7. A slack thus produced in the pull-down wire 19 due to the slight lowering of the carrier member 7 is removed by the upward movement of the spring leg 12*c*** as described.

When the carrier member 7 assumes its lowermost position, the winding drum 18 is forced to turn further in a clockwise direction, the pull-down wire 19 pulls the end gripper 20 thereof toward the side wall **7*d* of the carrier member 7 thereby reducing the clearance between the spring leg 12*c* (viz., the U-shaped holder portion 12*e*) and the side wall 7*d*. With this downward movement of the spring leg 12*c*, the other spring leg 12*b*** is moved down pulling the pull-up wire 13 to tighten the same. Thus, both the pull-up and pull-down wires 13 and 19 are tightened.

As will be understood from the above description, in the first embodiment, a single spring 12 is used for tensioning the two wires 13 and 19.

Figure 4:
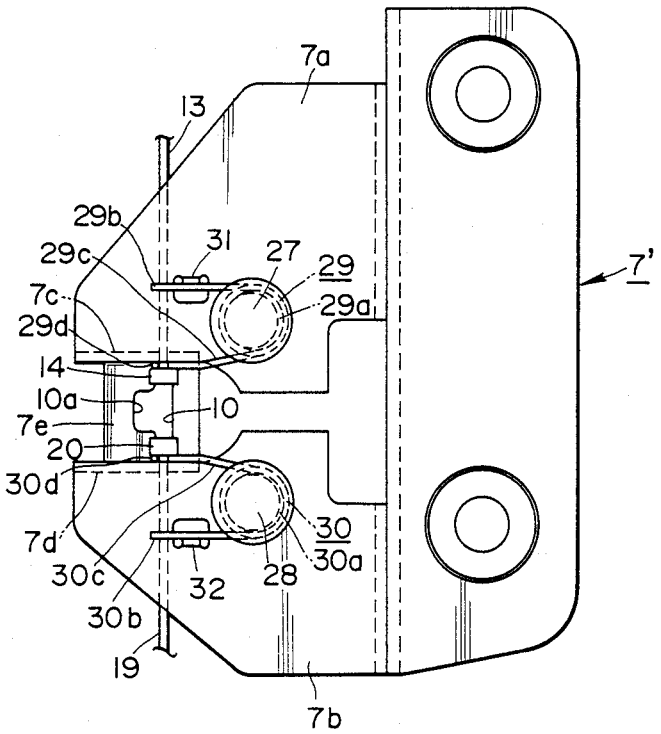
FIG. 4 is a front view of a carrier member employed in a door window regulator of the present invention.

Referring to FIG. 4, there is shown a carrier member 7' employed in a second embodiment of the present invention, in which the parts and constructions similar to those of the carrier member 7 of the first embodiment are designated by the same numerals. For facilitation, detailed description of such similar parts and constructions will be omitted from the following.

The carrier member 7' of this second embodiment comprises a base plate and a generally C-shaped wire holding plate which are the same in configuration as those of the afore-described carrier member 7 except for the rear wall **7*f* of the depressed bridge portion. That is, in the second embodiment, there is no portion corresponding to the rear wall 7*f*, as is understood from FIG. 4. Unlike the case of the first embodiment, the carrier member 7' of the second embodiment is provided with two torsion springs 29 and 30 for tensioning the pull-up and pull-down wires 13 and 19 respectively. For this, two headed pins 27 and 28 respectively fixed to the lug portions 7*a* and 7*b* near the depressed bridge portion. Each torsion spring 29 or 30 is disposed at its turned section 29*a* or 30*a* about the pin 27 or 28 with its two legs 29*b* and 29*c* or 30*b* and 30*c* extending outwardly, as shown. The legs 29*b* and 30*b* of the springs 29 and 30 are retained by respective stoppers 31 and 32 which are raised from the lug portions 7*a* and 7*b*. The other legs 29*c* and 30*c* of the spring are curled at their leading end portions to form U-shaped holder portions 29*d* and 30*d*, like in the case of the first embodiment. Upon assembly, each U-shaped holder portion 29*d* or 30*d* is thrusted between the wire end gripper 14 or 20 and the side wall 7*c* of 7*d* of the depressed bridge portion of the carrier member 7'. Of course, the springs 29 and 30 are so arranged as to bias the associated wire end grippers 14 and 20 toward each other so as to pull the wires 13 and 19** toward each other.

The operation of the second embodiment is substantially the same as that of the afore-mentioned first embodiment.

If desired, the following modifications may be employed in the present invention. That is, in the first embodiment, one of spring legs **12*b* and 12*c* may be retained by the neighbouring side wall 7*c* or 7*d* disengaging from the corresponding wire end gripper 14 or 20. In this case, the wire tensioning is effected by the remaining spring leg 12*c* or 12*b*. Furthermore, in the second embodiment, one of the springs 29 and 30** may be omitted.

The advantage of the present invention are as follows:

(1) Since the two wires 13 and 19 are arranged to travel along a common line, the action points of the wires to the carrier member 7 or 7' remain unchanged irrespective as to whether the carrier member is moved upward or downward. This induces smooth movement of the window glass pane.

(2) Since only the small-sized U-shaped holder portions of the spring 12 or springs 29 and 30 are practically incorporated with the two wires 13 and 19, it is not necessary to have the depressed bridge portion enlarged in size.

(3) Because the spring 12 or springs 29 and 30 are of a torsion type having two or three turns of coiled portion, mounting the spring or springs to the carrier member 7 or 7' does not enlarge the thickness of the carrier member.

(4) Because of the reduction in size of the carrier member 7 or 7', compact arrangement of the window regulator is available in the door construction.

(5) Since the spring 12 or springs 29 and 30 are arranged with the axes of the turned sections thereof extending perpendicular to a direction in which the weight of the window glass pane 8 is applied, undesirable jamming of the turns of the coiled portion of the spring or springs does not occur, unlike the case of the afore-mentioned conventional window regulator of FIG. 5.

What is claimed is:

1. A door window regulator for moving a window glass pane relative to a door in which said regulator is mounted, said window regulator comprising:

a guide rail attached to said door;

a carrier member slidably engaged with said guide rail to run along the same, said carrier member carrying thereon said window glass pane;

pull-up and pull-down wires which extend toward each other from opposed positions with respect to said carrier member and connected at their leading ends to spaced portions of said carrier member in such a manner that the wires extend along a common line;

drive means for driving said wires and thus said carrier member along said guide rail; and a wire tensioner mounted on said carrier member for tensioning said wires, said wire tensioner comprising a torsion spring having outwardly extending end portions, said end portions of said torsion spring being directly engaged with the leading ends of said wires to bias the same toward each other.

2. A door window regulator as claimed in claim 1, in which the other end portion of said torsion spring is engaged with the leading end of the other wire to bias the same toward said one of said wires.

3. A door window regulator as claimed in clain 2, in which the two end portions of said torsion spring cross each other before reaching to the leading ends of said wires.

4. A door window regulator as claimed in claim 2, in which said torison spring is fixed at its turned section to said carrier member through a pin.

5. A door window regulator as claimed in claim 4, in which said pin is fixed to a terrace portion integrally formed on said carrier member, said torsion spring being so arranged that the axis of the turned section there of perpendicular to a direction in which said carrier member moves.

6. A door window regulator as claimed in claim 4, further comprising wire end grippers which are fixed to the leading ends of said pull-up and pull-down wires for assuring the engagement between the end portions of the torsion spring and the leading ends of the wires.

7. A door window regulator as claimed in claim 6, in which each of said end portions of said torsion spring is curled to form a generally U-shaped holder portion.

8. A door window regulator as claimed in claim 7, in which said carrier member has a depressed bridge portion which comprises side walls and a bottom portion, said bridge portion being formed with a slit which extends from a middle portion of one side wall to a middle portion of the other side wall crossing entirely said bottom portion, said wire end grippers being put in said depressed bridge portion having their associated wires passed through the slit sections formed in said side walls.

9. A door window regulator as claimed in claim 8, in which the slit section of the bottom portion is formed with an enlarged portion which is so sized and formed as to pass therethrough said wire end grippers.

10. A door window regulator as claimed in claim 1, in which said wire tensioner further comprises another torsion spring having outwardly extending end portions, one end portion of this torsion spring being engaged with the leading end of the other wire to bias the same toward said one of said wires.

11. A door window regulator as claimed in claim 10, in which the other end portion of each torsion spring is retained by stopper portions formed on said carrier member.

12. A door window regulator as claimed in claim 11, in which said torsion springs are fixed at their respective turned sections to said carrier member through respective pins.

13. A door window regulator as claimed in claim 12, further comprising wire end grippers which are fixed to the leading ends of said pull-up and pull-down wires for assuring the engagement between the end portions of the torsion springs and the leading ends of the wires.

14. A door window regulator as claimed in claim 13, in which the end portions of the torsion springs, which are engaged with the leading ends of the wires, are each curled to form a generally U-shaped holder portion.

15. A door window regulator as claimed in claim 14, in which said carrier member has a depressed bridge portion which comprises side walls and a bottom portion, said bridge portion being formed with a slit which extends from a middle portion of one side wall to a middle portion of the other side wall crossing entirely said bottom portion, said wire end grippers being put in said depressed bridge portion having their associated wires passed through the slit sections formed in said side walls.

16. A door window regulator as claimed in claim 15, in which the slit section of the bottom portion is formed with an enlarged portion which is so sized and formed as to pass therethrough said wire end grippers.

17. A door window regulator for moving a window glass pane relative to a door in which said regulator is mounted, said window regulator comprising:

a guide rail attached to said door;

a carrier member slidably engageable with said guide rail to run along the guide rail, said carrier member being adapted to carry the window glass pane;

pull-up and pull-down wires positioned to extend toward one another from opposed positions with respect to said carrier member and connected at their leading ends to said carrier member in such a manner that the leading ends of the wire extend along a common line;

drive means for reversibly driving said wires, whereby said carrier runs along said guide rail when said wires are driven; and a wire tensioner mounted on said carrier member for tensioning said wires, said wire tensioner comprising a torsion spring having outwardly extending end portions formed integral with a coiled portion coiled about an axis, each of said end portions of said torsion spring being directly engageable with the leading end of one of said wires, said coiled portion being mounted to said carrier member such that the axis of said coiled portion is substantially perpendicular to the common line along which the leading ends of the wires extend, whereby said torsion spring biases the leading end of said wires toward one another.

* * * * *